US008474267B2

(12) United States Patent
Nager

(10) Patent No.: US 8,474,267 B2
(45) Date of Patent: Jul. 2, 2013

(54) RADIAL TURBINE ENGINE FLOATING RING SEAL

(75) Inventor: Eric Andrew Nager, El Cajon, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 845 days.

(21) Appl. No.: 12/398,670

(22) Filed: Mar. 5, 2009

(65) Prior Publication Data

US 2011/0179804 A1 Jul. 28, 2011

(51) Int. Cl.
*F02C 7/20* (2006.01)
*F02C 7/28* (2006.01)

(52) U.S. Cl.
USPC ..... 60/752; 60/754; 60/796; 60/804; 60/798; 60/799

(58) Field of Classification Search
USPC ..... 60/752, 753, 754, 796, 804, 798, 60/799
See application file for complete search history.

(56) References Cited

U.S. PATENT DOCUMENTS 3,115,011 A * 12/1963 Dcinhardt et al. ..... 60/804
4,195,476 A * 4/1980 Wood ..... 60/737
4,398,864 A * 8/1983 Camboulives et al. ..... 415/134
4,477,086 A 10/1984 Feder et al.
4,589,666 A 5/1986 Halling
4,686,823 A 8/1987 Coburn et al.
4,759,555 A 7/1988 Halling
4,901,522 A * 2/1990 Commaret et al. ..... 60/800
5,799,954 A 9/1998 Layer
6,237,921 B1 5/2001 Liotta et al.
6,352,267 B1 3/2002 Rode
6,896,480 B1 5/2005 Hagshenas et al.
7,024,863 B2 4/2006 Morenko
7,134,286 B2 11/2006 Markarian et al.
7,140,189 B2 11/2006 Markarian et al.
7,402,020 B2 7/2008 Beers et al.
2008/0166233 A1 * 7/2008 Johnson et al. ..... 415/230

OTHER PUBLICATIONS

Figure A—Prior Art, "Traditional Fixed 'Bird's Mouth' Seal".
Figure B—Prior Art.

* cited by examiner

*Primary Examiner* — William H Rodriguez
*Assistant Examiner* — Steven Sutherland
(74) *Attorney, Agent, or Firm* — Carlson, Gaskey & Olds, P.C.

(57) ABSTRACT

A turbo machine is provided that includes a turbine nozzle having a wall. The wall provides spaced apart first and second surfaces. A combustor includes a liner having an annular lip that engages one of the first and second surfaces. A floating ring seal is supported by the liner in a slip-fit relationship, for example, using a retainer. The floating ring seal engages the other of the first and second surfaces. The floating ring seal is slidably moveable relative to the liner in a floating direction in response to movement of the liner in a radial direction.

12 Claims, 2 Drawing Sheets

RADIAL TURBINE ENGINE FLOATING RING SEAL

This invention was made with government support with the United States Navy under Contract No.: N00019-06C-0081. The government therefore has certain rights in this invention.

BACKGROUND

This disclosure relates to a turbine engine seal that is used to seal a combustor relative to a turbine nozzle.

Turbo machines or engines, such as auxiliary power units, have two typical configurations for turbines. An axial turbine engine generally provides an axial flow path through the turbine. Compressed fluid exiting the combustor flows in a generally axial path through the turbine. In a radial turbine engine, the compressed fluid exits the combustor and enters the turbine radially. Each turbo machine presents unique challenges to sealing the combustor relative to a turbine nozzle.

Some axial turbine engines include a combustor sealing arrangement having a floating ring seal. One end of the floating ring seal is received in a radially oriented U-shaped structure provided by the combustor for permitting the floating ring seal to slide radially relative to a combustor liner. An opposite end of the floating ring seal provides a seal against an outer diameter of an outer wall of the turbine nozzle. No other structure on the combustor is used to seal against the outer wall.

A "birds mouth" seal has been used in some radial turbine engines to seal the combustor relative to the turbine nozzle. A portion of the combustor liner is arranged on one side of a nozzle wall, and a seal, which is secured to the combustor liner by a braze, is arranged on the other side of the nozzle wall. As the combustor vibrates and expands during operation, the brazed joint or the liner can crack. What is needed is a more robust seal for a radial turbine engine.

SUMMARY

A turbo machine is provided that includes a turbine nozzle having a wall. The wall provides spaced apart first and second surfaces. A combustor includes a liner having an annular lip that engages one of the first and second surfaces. A floating ring seal is supported by the liner in a slip-fit relationship, for example, using a retainer. The floating ring seal engages the other of the first and second surfaces. The floating ring seal is slidably moveable relative to the liner in a floating direction in response to movement of the liner in a radial direction.

These and other features of the disclosure can be best understood from the following specification and drawings, the following of which is a brief description.

DETAILED DESCRIPTION

Figure 1:
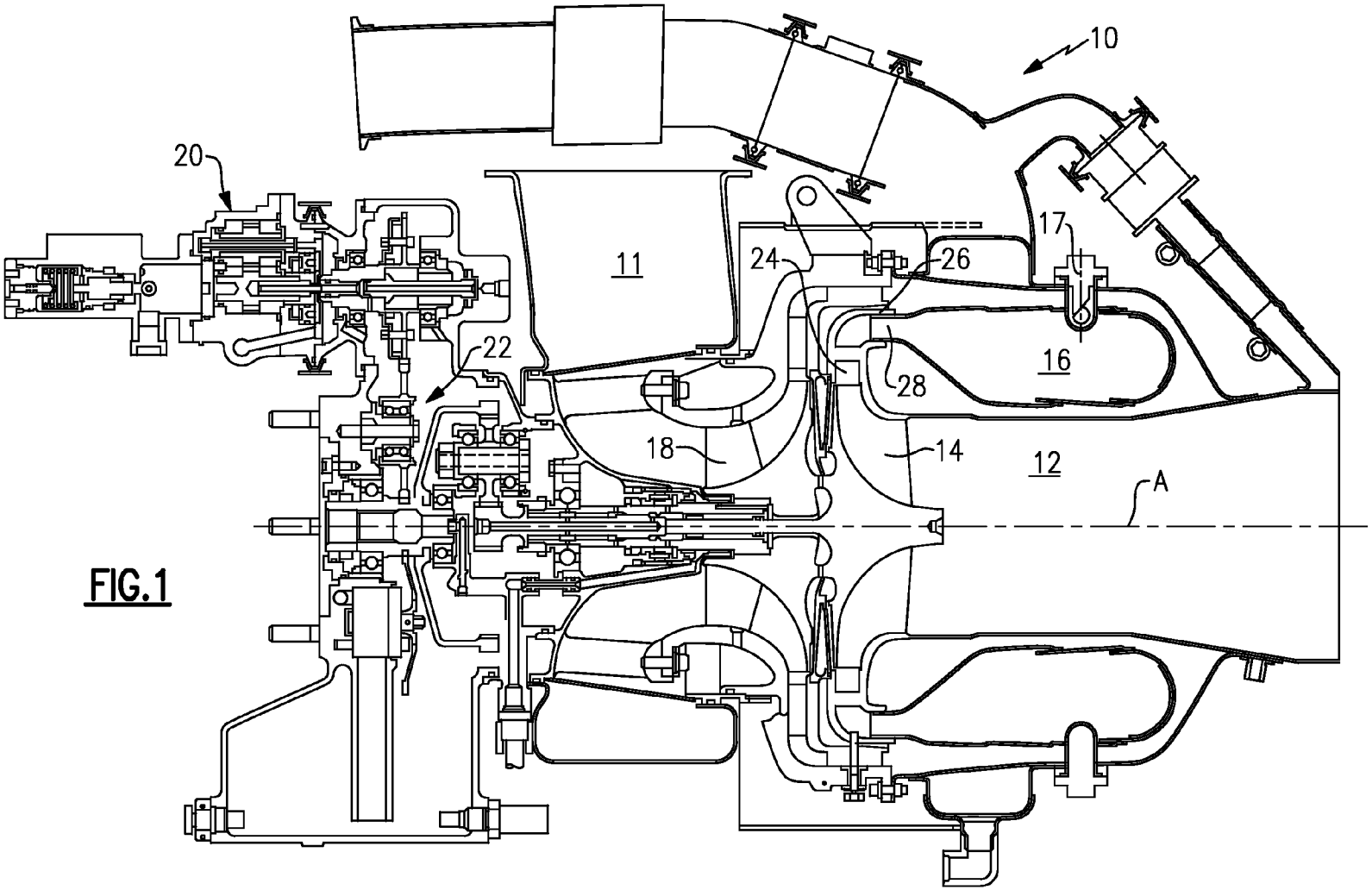
FIG. 1 is a cross-sectional view of an example radial turbine engine.

A turbo machine 10 is illustrated in FIG. 1. The example turbo machine 10 is a radial turbine engine. The turbo machine 10 includes an inlet plenum 11 that provides air to a compressor 18 that is rotatable about an axis A. The compressor 18 compresses air from the inlet plenum 11 and supplies the air to a combustor 16, which provides a combustion chamber. The combustor 16 includes a fuel injector 17 that introduces and burns fuel in the combustion chamber using the compressed air to supply hot gases to drive a turbine 14, which is rotatable about the axis A. The turbine 14 rotates a shaft that drives a gearbox 22, which rotationally drives a component 20. Gases from the turbine 14 are exhausted out and outlet 12.

The turbo machine 10 is a radial arrangement in which the compressed air radially exits blades of the compressor 18. A combustor outlet 28 of the combustor 16 is fluidly connected to an inlet 26 of a turbine nozzle 24. In the example, the combustor 16 is provided by a liner 23 that is secured to the inlet 26 by an interference fit. A seal must be provided between the combustor 16 and the turbine nozzle 24 to prevent leakage between these components and accommodate vibration and thermal gradients.

Figure 2:
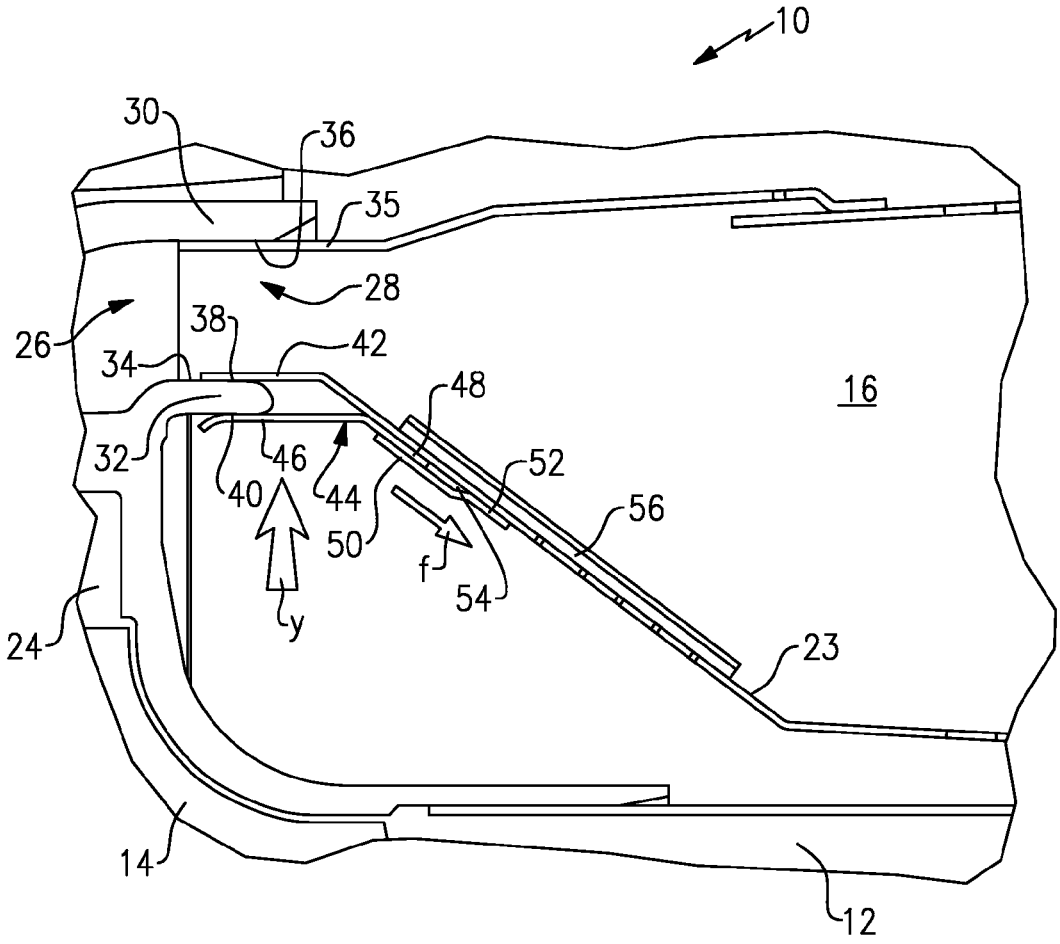
FIG. 2 is an enlarged cross-sectional view of a portion of a combustor and a compressor outlet nozzle.

Referring to FIG. 2, the inlet 26 provides an annular opening defined by spaced apart, concentric outer and inner walls 30, 32. The combustor outlet 28 is also annular and sized relative to the inlet 26 of turbine nozzle 24 to provide the interference fit. In the example shown, the combustor outlet 28 is received inside a throat 34 of the inlet 26. More specifically, an outer portion 35 of the liner 23 engages an inner diameter surface 36 of the outer wall 30. An annular lip 42 of the liner 23 engages a first surface provided by an outer diameter surface 38 of the inner wall 32.

To enhance the seal between the combustor 16 and the inner wall 32, a floating ring seal 44 is supported by the liner 23 in a slip-fit relationship to engage a second surface provided by an inner diameter 40 of the inner wall 32. Said another way, the annular lip 42 and the floating ring seal 44 are spaced apart from one another in a radial direction relative to the axis A, and the inner wall 32 is received in sealing engagement within an annular pocket between the annular lip 42 and the floating ring seal 44.

In the example, the inner wall 32 extends in the axial direction A. The floating ring seal 44 includes a lateral portion 46 that is parallel with the annular lip 42 and which extends in the axial direction A. The floating ring seal 44 includes an angled portion 48, which is conical in shape, extending inwardly from the lateral portion 46 that is received between a slot 54 provided by the liner 23 and a retainer 50. The retainer 50 is secured to the liner 23 at a joint 52 by a braze material, for example.

In operation, as the combustor 16 expands in a radial direction Y, the angled portion 48 slides in a floating direction F within the slot 54. The floating direction F and radial direction Y are different than one another, and in the example, at an obtuse angle relative to one another. The angled portion 48 generates a load on the retainer 50 in a direction opposite the direction Y. However, the load is sufficiently less than a typical load on a fixed seal "birds mouth" arrangement due to the slip-fit relationship of the angled portion within the slot 54. As a result, a braze at joint 52 to secure the retainer 50 to the liner 23 is sufficient.

A sliding enhancement feature can be used to ensure that the floating ring seal 44 will maintain a slip-fit relationship relative to the liner 23 and the retainer 50, such as dissimilar metals. For example, the liner 23 and retainer 50 can be constructed from an INCONEL 625 or HASTELLOY, and the floating ring seal 44 can be constructed from a HASTEX material. Additionally or alternatively, a coating can be provided on one or more of the sliding surfaces between the floating ring seal 44, liner 23 and/or retainer 50.

Although example embodiments have been disclosed, a worker of ordinary skill in this art would recognize that certain modifications would come within the scope of the claims.

For that reason, the following claims should be studied to determine their true scope and content.

What is claimed is:

1. A turbo machine comprising:

a turbine nozzle including a wall providing spaced apart first and second surfaces;

a combustor including a liner having an annular lip engaging one of the first and second surfaces, the combustor extends along an axis of the turbo machine normal to a radial direction; and a floating ring seal supported by the liner in a slip fit relationship, the floating ring seal engaging the other of the first and second surfaces, the floating ring seal slideably movable relative to the liner in a floating direction, which includes a radial component, in response to movement of the liner in the radial direction, wherein the floating direction is transverse to the radial direction and the axis, and wherein the annular lip, a lateral portion of the floating ring seal and the wall are spaces radially relative to one another.

2. The turbo machine according to claim 1, wherein the lateral portion is generally parallel to the annular lip, and an angled portion extending from the lateral portion.

3. The turbo machine according to claim 2, wherein the lateral portion engages the other of the first and second surfaces and the angled portion engages the liner in the slip-fit relationship.

4. The turbo machine according to claim 3, comprising a retainer secured to the liner and providing a slot receiving the angled portion in the slip-fit relationship.

5. The turbo machine according to claim 2, wherein the annular lip, the wall, and the lateral portion are parallel from one another and extend in a generally axial direction.

6. A combustor for a turbo machine comprising:

a liner having an annular lip, the combustor is configured to extend along an axis of the turbo machine normal to a radial direction; and a floating ring seal supported by the liner in a slip fit relationship, the floating ring seal spaced apart from and generally parallel to the annular lip to provide an annular pocket, the floating ring seal slideably movable relative to the liner in a floating direction, wherein the floating direction is transverse to the radial direction and the axis, and wherein the annular lip and a lateral portion of the floating ring seal are spaced radially relative to one another.

7. The combustor according to claim 6, wherein the floating ring seal includes a lateral portion generally parallel to the annular lip, and an angled portion extending from the lateral portion.

8. The combustor according to claim 7, wherein the angled portion engages the liner in the slip-fit relationship.

9. The combustor according to claim 8, comprising a retainer secured to the liner and providing a slot receiving the angled portion in the slip-fit relationship.

10. The combustor according to claim 7, wherein the annular lip and the lateral portion are parallel from one another and extend in a generally axial direction.

11. The combustor according to claim 6, wherein at least one of the combustor and the floating ring seal including a sliding enhancement feature configured to enhance the slip-fit relationship.

12. A turbo machine comprising:

a turbine rotatable along an axis and including a blade;

a turbine nozzle in fluid communication with the turbine and aligned radially with the blade relative to the axis, the turbine nozzle including a wall providing spaced apart first and second surfaces;

a combustor including a liner having an annular lip engaging one of the first and second surfaces, and a retainer secured to the liner defines a slot together with the liner, the combustor extends along an axis of the turbo machine normal to a radial direction; and a floating ring seal supported by the liner in the slot in a slip fit relationship and engaging the other of the first and second surfaces, the floating ring seal slideably movable relative to the liner in a floating direction within the slot in response to movement of the liner in the radial direction, wherein the floating direction is transverse to the radial direction and the axis, and wherein the annular lip, a lateral portion of the floating ring seal and the wall are spaced radially relative to one another.

* * * * *